US009841165B1

(12) United States Patent
Inoue et al.

(10) Patent No.: US 9,841,165 B1
(45) Date of Patent: Dec. 12, 2017

(54) LED LAMP

(71) Applicant: Phoenix Electric Co., Ltd., Himeji-shi, Hyogo (JP)

(72) Inventors: Tomohiko Inoue, Himeji (JP); Tetsuya Gouda, Himeji (JP); Kenichi Yamashita, Himeji (JP); Kana Watanabe, Himeji (JP)

(73) Assignee: PHOENIX ELECTRIC CO., LTD., Hyogo (JP)

( * ) Notice: Subject to any disclaimer, the term of this patent is extended or adjusted under 35 U.S.C. 154(b) by 0 days.

(21) Appl. No.: 15/667,145

(22) Filed: Aug. 2, 2017

(30) Foreign Application Priority Data

Feb. 22, 2017 (JP) ..... 2017-30723

(51) Int. Cl.

| | |
|---|---|
| ***F21V 7/06*** | (2006.01) |
| ***F21K 9/69*** | (2016.01) |
| ***F21V 3/04*** | (2006.01) |
| *F21Y 115/10* | (2016.01) |

(52) U.S. Cl.
CPC ..... *F21V 7/06* (2013.01); *F21K 9/69* (2016.08); *F21V 3/0436* (2013.01); *F21Y 2115/10* (2016.08)

(58) Field of Classification Search
CPC . F21V 7/06; F21V 3/0436; F21K 9/69; F21Y 2115/10
See application file for complete search history.

(56) References Cited

U.S. PATENT DOCUMENTS

| | | | | |
|---|---|---|---|---|
| 2010/0164349 | A1 | 7/2010 | Kazmierski | |
| 2011/0080728 | A1 | 4/2011 | Nakagawa et al. | |
| 2012/0063146 | A1 | 3/2012 | Kawagoe et al. | |
| 2015/0241024 | A1* | 8/2015 | Smith | F21K 9/233 362/296.07 |

FOREIGN PATENT DOCUMENTS

| | | | |
|---|---|---|---|
| JP | H06237017 | A | 8/1994 |
| JP | 2010157381 | A | 7/2010 |
| JP | 2011082011 | A | 4/2011 |
| JP | 2011108583 | A | 6/2011 |
| JP | 2011175978 | A | 9/2011 |

* cited by examiner

*Primary Examiner* — David V Bruce
(74) *Attorney, Agent, or Firm* — Lucas & Mercanti, LLP

(57) ABSTRACT

A light emitting diode lamp is composed of a reflective mirror, a pillar and a plurality of light emitters disposed in radial arrangement about a focal point of the reflective mirror on the surface of the pillar. Each of the plurality of light emitters is composed of a light emitting diode and a lens forming a virtual image in a position of the focal point located behind the light emitting diode. Additionally, a plurality of light emitting diode elements composing the light emitting diode in each of the plurality of light emitters emit light rays with the same wavelength, and the light emitting diodes in the plurality of light emitters emit the light rays with at least two types of wavelength.

6 Claims, 7 Drawing Sheets

LED LAMP

CROSS REFERENCE TO RELATED APPLICATION

This application claims the priority of Japanese Patent Application No. 2017-30723 filed on Feb. 22, 2017, which is incorporated by reference herein.

BACKGROUND OF THE INVENTION

Field of the Invention

The present invention relates to a light emitting diode lamp (LED lamp) including a plurality of light emitting diodes.

Background Art

Light emitting diodes have advantages that the power consumption thereof is lower and the life thereof is longer compared to well-known incandescent lamps (e.g., halogen lamps). With enhancement in awareness of ecology by demanders, the usage fields of the light emitting diodes have been rapidly expanding as one of the measures for energy saving. Especially, demanders have been increasingly demanding to use the light emitting diodes as substitutions of the incandescent lamps.

Despite the demand, light emitting diode elements have a drawback that the amount of light per light emitting diode element is smaller than that per incandescent lamp. To compensate this drawback, there has been developed a type of light emitting diode lamp provided with a plurality of light emitting diode elements so as to be capable of outputting a large amount of light (e.g., Japan Laid-open Patent Application Publication No. H06-237017).

In the light emitting diode lamp described in Japan Laid-open Patent Application Publication No. H06-237017, each of light emitting diodes is composed of a plurality of light emitting diode elements disposed in grid arrangement. Moreover, light rays to be emitted from the light emitting diode elements, respectively, do not have the same wavelength. For example, three types of light emitting diode elements, emitting red light rays, blue light rays and green light rays, respectively, are used in a suitable ratio, whereby the light emitting diode lamp is configured to illuminate a physical object with color light rays.

However, the light emitting diode lamp described in Japan Laid-open Patent Application Publication No. H06-237017 has a drawback. Specifically, a reflective mirror (reflector) is used in attempt to transmit light rays from the light emitting diodes at a predetermined degree of light concentration over a predetermined distance, and the light rays from the light emitting diodes are configured to be reflected by the reflective surface of the reflective mirror. Especially, a type of reflective mirror, the reflective surface of which is made in the shape of a paraboloid of revolution, is configured to be used in attempt to transmit the light rays from the light emitting diodes over a far distance. The paraboloid of revolution has one focal point F. Light rays, emitted from the focal point F, are reflected by the paraboloid of revolution and then exit from the reflective mirror in the form of collimated light, rays of which are parallel to each other.

In the case of the light emitting diode composed of the plural light emitting diode elements disposed in alignment, for instance, even when the focal point F of the reflective mirror is designed to be matched with the geometric center position of the light emitting diodes, only light rays, emitted from the light emitting diode element with which the focal point F is matched, are considered as collimated light in a true sense. On the other hand, the other light emitting diode elements are disposed in positions displaced from the focal point F. Therefore, exactly speaking, light rays emitted from the other light emitting diode elements are not considered as collimated light.

Such "displacement" is subtle, and hence, may not pose a big problem when a physical object to be illuminated by the light emitting diode lamp is located at a near distance. However, when the physical object is located at a far distance from the light emitting diode lamp, the aforementioned "displacement" cannot be ignored.

Specifically, when the light rays emitted from the light emitting diode element with which the focal point F of the reflective mirror is matched (hereinafter referred to as "focal-point light rays") are cast on the center of the physical object, the light rays emitted from the light emitting diode elements disposed in positions displaced from the reflective mirror (hereinafter referred to as "non-focal-point light rays") are supposed to illuminate positions displaced from the center of the physical object. This is not problematic when the wavelength of "focal-point light rays" and that of "non-focal-point light rays" are the same. However, when the wavelength of "focal-point light rays" and that of "non-focal-point light rays" are different from each other, the physical object inevitably includes a region (1) on which only "focal-point light rays" are cast, a region (2) on which both "focal-point light rays" and "non-focal-point light rays" are cast, and a region (3) on which only "non-focal-point light rays" are cast. In other words, the regions (1) to (3) are illuminated by different shades of color. Consequently, there has been a drawback that the physical object appears to have "uneven" shades of color.

The present invention has been developed in view of the aforementioned drawback of the well-known art. Therefore, it is a main object of the present invention to provide a light emitting diode lamp that makes a physical object unlikely to appear to have uneven shades of color even in illuminating the physical object with light rays having a plurality of types of wavelength.

SUMMARY OF THE INVENTION (1) According to an aspect of the present invention, a light emitting diode lamp is provided that includes a reflective mirror, a pillar and a plurality of light emitters. The reflective mirror includes a reflective surface on an inner side thereof. The reflective surface is defined by a surface of revolution, and includes an opening and a focal point. The pillar extends from a bottom part of the reflective surface toward the opening. The plurality of light emitters are disposed in radial arrangement around the focal point on a surface of the pillar. The light emitting diode lamp is characterized in that each of the plurality of light emitters includes a light emitting diode and a lens. The light emitting diode includes a plurality of light emitting diode elements that emit light rays toward the reflective surface. The lens is disposed between the light emitting diode and the reflective surface, refracts the light rays emitted from the light emitting diode toward the reflective surface, and forms a virtual image of the light emitting diode in a position of the focal point located behind the light emitting diode. Moreover, the plurality of light emitting diode elements of the light emitting diode in the each of the plurality of light emitters emit the light rays with the same wavelength, and the light emitting diodes of the plurality of light emitters emit the light rays with at least two types of wavelength.

(2) It is preferable that the light emitting diodes of the plurality of light emitters emit the light rays in at least two amount settings.

(3) It is preferable that the reflective surface is defined by a paraboloid of revolution, and the following relational expression is established between a diameter of the opening of the reflective surface and a pillar radius of the pillar:

$$0.05\times A<B\leq 0.1485\times A,$$

where A: the diameter (mm) of the opening of the reflective surface, and

B: the pillar radius (mm).

(4) It is preferable that the reflective surface is defined by a paraboloid of revolution, and the following relational expression is established between a diameter of the opening of the reflective surface and a pillar radius of the pillar:

$$0.05\times A<B\leq 0.109\times A,$$

where A: the diameter (mm) of the opening of the reflective surface, and

B: the pillar radius (mm).

(5) It is preferable that the pillar radius of the pillar is set such that the light emitting diode reaches a temperature at which the light emitting diode emits light rays with a predetermined wavelength.

Advantageous Effects of Invention

According to the present invention, the plurality of light emitting diode elements composing one light emitting diode are configured to emit light rays with the same wavelength, while the entire light emitting diodes are configured to emit light rays with at least two types of wavelength. With this configuration, one light emitting diode illuminates a physical object while the light rays emitted from the light emitting diode elements composing one light emitting diode are "displaced" at a predetermined amount. However, the light emitting diode elements composing one light emitting diode emit light rays with the same wavelength. Therefore, even with the light rays "displaced" as described above, the physical object does not appear to have uneven shades of color.

Additionally, the light emitting diodes emit light rays with at least two types of wavelength. In other words, a given light emitting diode emits light rays with different wavelength from those emitted from the other light emitting diode (or diodes). As described above, one light emitting diode is herein configured to emit light rays with the same wavelength. Therefore, when the given light emitting diode illuminates a physical object with light rays "displaced" by a predetermined amount, the other light emitting diode (or diodes) is configured to illuminate the physical object with light rays that are similarly "displaced" and have different wavelength from those emitted from the given light emitting diode. Thus, the physical object is illuminated with light rays that are similarly "displaced" and have different wavelengths from each other. Consequently, the physical object can be inhibited from appearing to have uneven shades of color.

BRIEF DESCRIPTION OF THE DRAWINGS

Referring now to the attached drawings which form a part of this original disclosure.

DETAILED DESCRIPTION OF EMBODIMENTS

Figure 1:
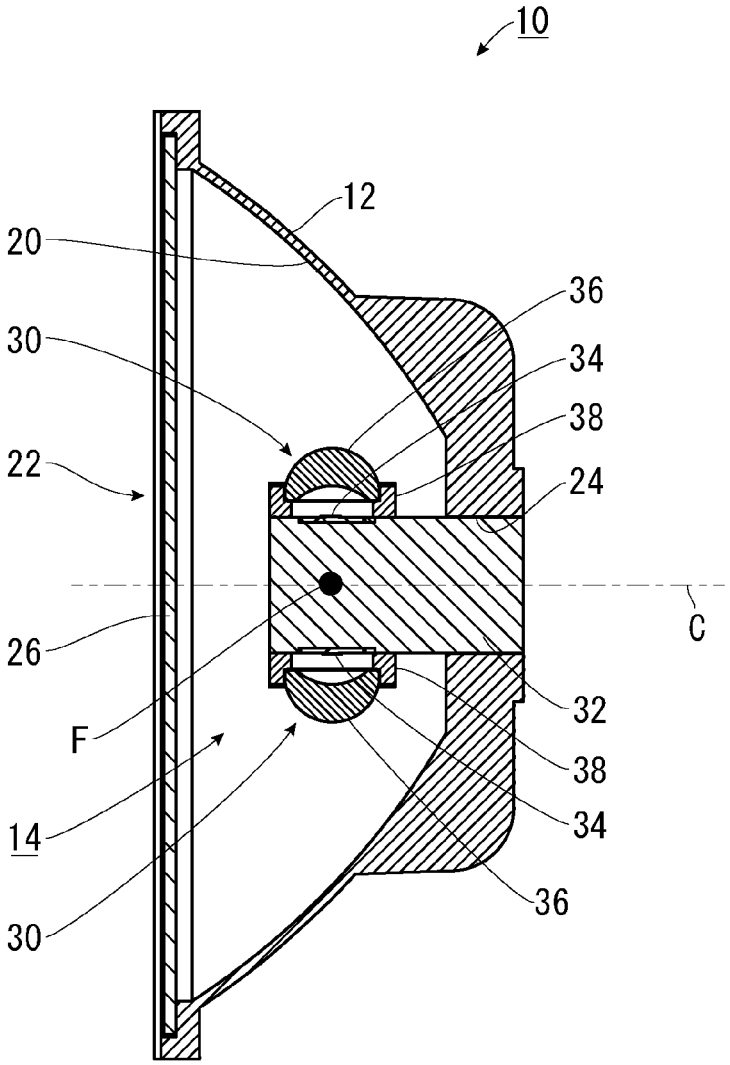
FIG. 1 is a cross-sectional view of an example of a light emitting diode lamp 10 to which the present invention is applied.
Figure 2:
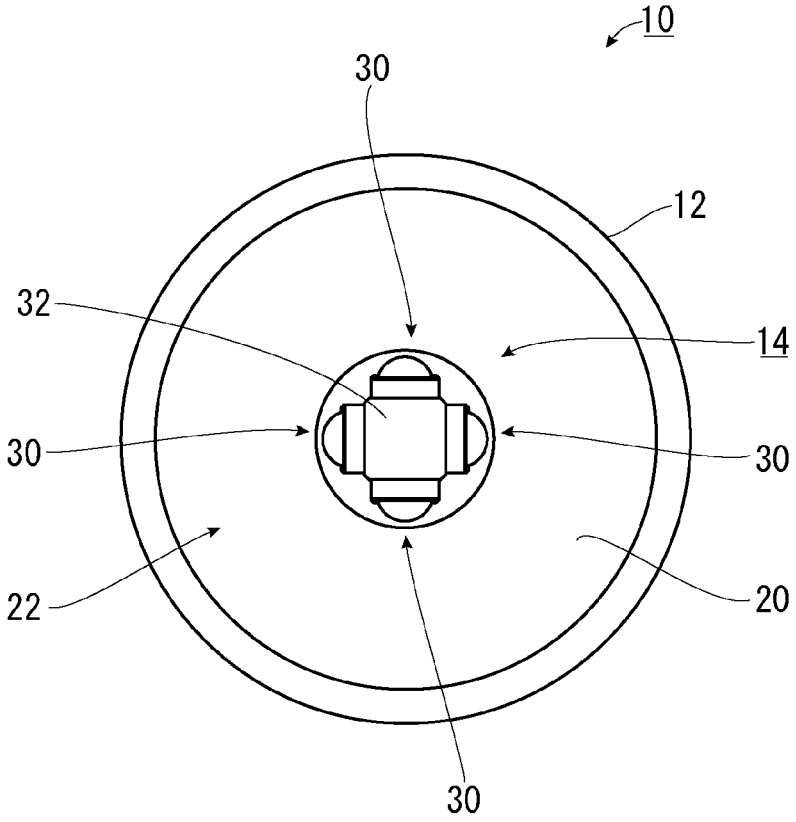
FIG. 2 is a front view of the example of the light emitting diode 10 to which the present invention is applied.

A light emitting diode lamp 10 to which the present invention is applied will be hereinafter explained. As shown in FIGS. 1 and 2, the light emitting diode lamp 10 comprises a reflective mirror 12 having a bowl shape and a light emitting diode light source 14.

The reflective mirror 12 includes a reflective surface 20, an opening 22 and a middle tubular attachment part 24. The reflective surface 20 is provided on the inner side of the reflective mirror 12. The opening 22 causes light rays reflected by the reflective surface 20 to be released therethrough. The middle tubular attachment part 24, having an approximately cylindrical shape, is disposed in the middle of the bottom part of the reflective surface 20 so as to be opposed to the opening 22. Additionally, an imaginary straight line, arranged orthogonal to the opening 22 while passing through the center of the reflective mirror 12, is defined as a center axis C of the reflective mirror 12 (and the reflective surface 20).

Glass, aluminum or so forth is used as the material of the reflective mirror 12. When aluminum is used as the material of the reflective mirror 12, metal vapor deposition is performed for the reflective surface 20. When glass is used as the material of the reflective mirror 12, metal vapor deposition is performed for the reflective surface 20, and other than this, the reflective surface 20 is formed as a multilayer film on the inner surface of a bowl-shaped part (i.e., the surface on which the reflective surface 20 is formed). Especially in the light emitting diode lamp 10, heat from light emitting diodes 34 (to be described) composing the light emitting diode light source 14 is efficiently radiated by a pillar 32 (to be described). Therefore, resin or so forth, which is more thermally sensitive than glass, aluminum or so forth, is also usable as the material of the reflective mirror 12. It should be noted that in the present practical example, a front side cover 26 made of polycarbonate is attached to the reflective mirror 12 so as to cover the opening 22. However, the front side cover 26 is not an essential constituent element of the light emitting diode lamp 10. Additionally, another material such as glass is usable as the material of the front side cover 26 as long as it is a transparent material.

The reflective surface 20 is defined by a surface of revolution about the aforementioned center axis C, and a focal point F is set on the center axis C on the inside of the reflective mirror 12. The focal point F is set in the optimal position based on factors such as the size and the number of the light emitting diodes 34 accommodated inside the reflective mirror 12. For example, when each light emitting diode 34 is large or when a large number of the light emitting diodes 34 are provided, the focal point F is set in a position located somehow at a distance from the bottom part of the reflective surface 20. Contrarily, when each light emitting diode 34 is small or when a small number of the light emitting diodes 34 are provided, the focal point F is set in a position located closely to the bottom part of the reflective surface 20. It should be noted that when the surface of revolution, by which the reflective surface 20 is defined, is a spheroid or paraboloid, the focal point F of the reflective surface 20 is the focal point of an ellipse or parabola by which the spheroid or paraboloid is defined.

Figure 3:
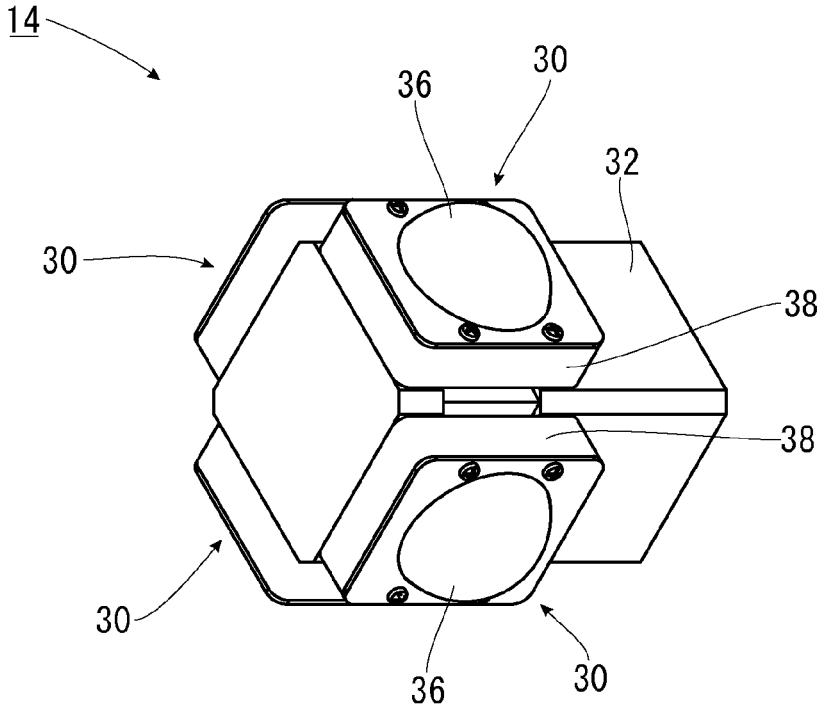
FIG. 3 is a perspective view of an example of a light emitting diode light source 14 to which the present invention is applied.

With reference to FIG. 3 as well as FIGS. 1 and 2, the light emitting diode light source 14 is composed of four light emitters 30 and the pillar 32 holding these light emitters 30 in predetermined positions. It should be noted that the number of the light emitters 30 is not limited to four, and advantageous effects of the present invention can be achieved by using two or more light emitters 30.

Figure 4:
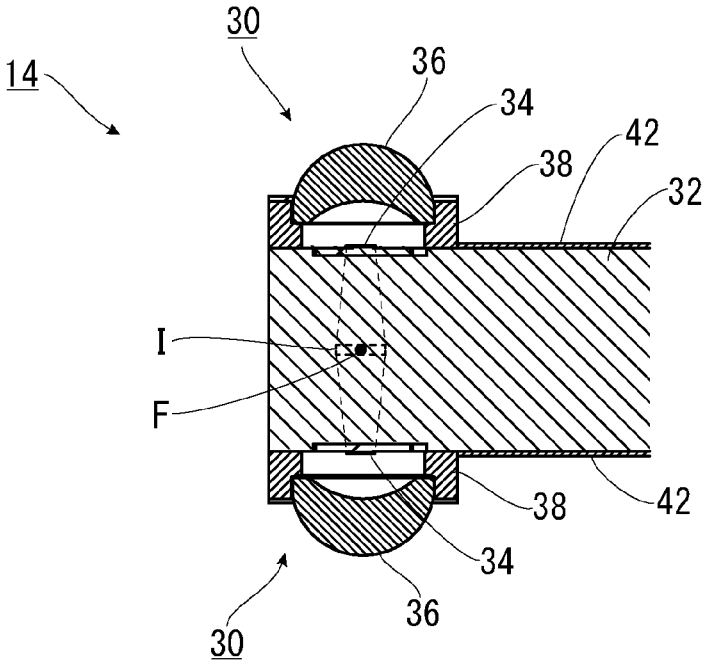
FIG. 4 is a cross-sectional view of the example of the light emitting diode light source 14 to which the present invention is applied.

As shown in FIG. 4, each of the light emitters 30 comprises the light emitting diode 34, a lens 36 and a lens holding member 38. The four light emitters 30, used in the present practical example, are disposed on the tip of the pillar 32 in radial arrangement at equal intervals in the circumferential direction around the focal point F of the reflective surface 20. The pillar 32 is made in the shape of an approximately quadrangular prism, and extends from the bottom part of the reflective surface 20 along the center axis C.

Figure 5:
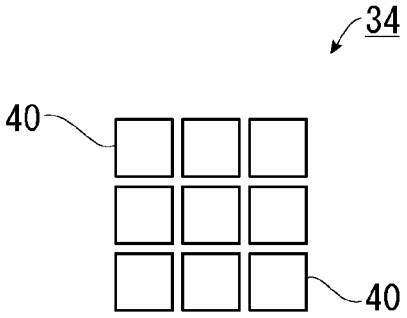
FIG. 5 is a diagram of an example of a light emitting diode 34.

As shown in FIG. 5, each light emitting diode 34 comprises a plurality of light emitting diode elements 40. It should be noted that in the present practical example, each light emitting diode 34 is composed of nine light emitting diode elements 40 disposed in grid arrangement. The number of the light emitting diode elements 40 composing each light emitting diode 34 is not limited to this, but is preferably set to be two or more.

Each light emitting diode element 40 is an electronic component that emits light rays with a specific wavelength at an aperture angle θ of, for instance, 120 degrees the aperture angle θ is not limited to 120 degrees) when supplied with a predetermined current. In the present practical example, the plural light emitting diode elements 40 composing one light emitting diode 34 are all configured to emit light rays with the same wavelength. Additionally, the light rays emitted from the light emitting diodes 34 have at least two types of wavelength. For example, in the light emitting diode lamp 10 of the present practical example, four light emitters 30 are used, and therefore, four light emitting diodes 34 are used. Among the four light emitting diodes 34, any three of them are configured to emit light rays with the same wavelength, whereas remaining one of them is configured to emit light rays with a wavelength different from the light rays to be emitted from the three. The configuration of emitting light rays is not limited to this. Any two of the four light emitting diodes 34 may be configured to emit light rays with the same wavelength, whereas remaining two of the four light emitting diodes 34 may be configured to emit light rays with a wavelength different from the light rays to be emitted from the two. Furthermore, the four light emitting diodes 34 may be configured to emit light rays with four different types of wavelength.

Additionally, light rays with any types of wavelength (ultraviolet light rays, visible light rays, infrared light rays, etc.) may be combined as the light rays to be emitted from the light emitting diodes 34, respectively. For example, three types of visible light rays, such as red, blue and green visible light rays, can be combined. Alternatively, a plurality of types of infrared light rays with wavelengths different from each other can be combined.

Referring back to FIGS. 1 and 4, each lens 36 is a convex meniscus lens made of polycarbonate, and is disposed between each light emitting diode 34 and the reflective surface 20 so as to be arranged in opposition to and in separation from each light emitting diode 34. It should be noted that the meniscus lens refers to a type of lens having one surface thereof is made in the shape of a convex surface whereas the other surface thereof is made in the shape of a concave surface. Additionally, each lens 36 is an optical component that refracts light rays emitted from its relevant light emitting diode 34 toward the reflective surface 20 and forms a virtual image I of the relevant light emitting diode 34 on the back of the relevant light emitting diode 34. The material of each lens 36 is not limited to polycarbonate, and a material such as glass is usable as the material of each lens 36.

As shown in FIG. 4, the virtual image I formed on the back of each light emitting diode 34 is enlarged than the actual dimension of each light emitting diode 34. Moreover, the formed virtual image I tends to be enlarged in dimension as the position thereof separates from the actual position of this light emitting diode 34. It should be noted that not only the convex meniscus lens but also a plano-convex lens or a biconvex lens is usable. However, the convex meniscus lens is preferably used in consideration of the fact that when light rays emitted from each light emitting diode 34 are incident on the right and left ends of each lens 36, the incident light rays are reflected by the incident surface of each lens 36 and are likely to become stray rays.

Additionally, the virtual image I of the light emitting diode 34, formed by the lens 36 in each light emitter 30, is set such that the geometric center thereof is located in the focal point F of the reflective surface 20. As a means for setting the virtual image I in such a position, the position of the virtual image I may be optically adjusted by adjusting the refractive index of the lens 36. Alternatively, the cross-sectional dimension of the pillar 32 may be adjusted. The position of the virtual image I gradually separates from the focal point F with reduction in cross-sectional dimension of the pillar 32. Contrarily, the position of the virtual image I gradually approaches to the focal point F with increase in cross-sectional dimension of the pillar 32. The both means may be used simultaneously.

Each lens holding member 38 is an annular body made of metal, opaque resin, translucent resin or so forth. One end of each lens holding member 38 is attached to the surface of the pillar 32 so as to surround each light emitting diode 34, while each lens 36 is fitted to (or alternatively, may be integrated with) the other end of each lens holding member 38. When each lens holding member 38 is made of metal or opaque resin, the entirety of light rays emitted from each light emitting diode 34 is emitted through each lens 36. On the other hand, when each lens holding members 38 is made of translucent resin, most of the light rays are emitted through each lens 36, but part of the light rays is emitted through each lens holding member 38 made of translucent resin.

The pillar 32 is a quadrangular prism material made of aluminum, and extends from the bottom part of the reflective surface 20 along the center axis C. When the number of the light emitters 30 is herein three, for instance, a triangular prism material is preferably used as the pillar 32. Alternatively, when the number of the light emitters 30 is five, a pentagonal prism material is preferably used as the pillar 32. Also, any other material such as copper may be herein used for the pillar 32 as long as it exerts high thermal conductivity. Furthermore, the four light emitters 30 are disposed on the tip of the pillar 32 in radial arrangement at equal intervals in the circumferential direction around the focal point F of the reflective surface 20.

As described above, the pillar 32 is made of aluminum with high thermal conductivity. Therefore, the pillar 32 is configured to quickly receive heat, generated simultaneously with light emission of the light emitting diodes 34, from the light emitting diodes 34. In other words, the pillar 32 is not only a holder of the light emitting diodes 34 and the lenses 36 but also a radiator for the light emitting diodes 34. By the way, the other end of the pillar 32 is inserted into the middle tubular attachment part 24 of the reflective mirror 12, and is then adhered to the reflective mirror 12 by silicone adhesive or so forth (FIG. 1).

Power supply members 42 are disposed on the four lateral surfaces of the pillar 32, respectively, to supply electric power to the light emitting diodes 34, respectively (FIG. 4). Electric power is configured to be supplied to the light emitting diodes 34 through the power supply members 42, respectively. In the present practical example, the pillar 32 is made of aluminum. Therefore, insulation is required between the pillar 32 and the power supply members 42. It should be noted that electric power is supplied to the power supply members 42 from an external power source (not shown in the drawings) through lead wires (not shown in the drawings). Alternatively, electric power may be configured to be directly supplied to the light emitting diodes 34 with lead wires.

The following is an example of the procedure of manufacturing the light emitting diode lamp 10. The light emitting diodes 34 are adhered to the pillar 32, and then, are electrically connected to the power supply members 42, respectively. Thus, the light emitting diodes 34 are mounted to the pillar 32. Next, the lens holding members 38 are disposed in the surroundings of the light emitting diodes 34, respectively, and then, the lenses 36 are attached to the lens holding members 38, respectively. Subsequently, the pillar 32 is inserted into the middle tubular attachment part 24 of the reflective mirror 12, and is fixed thereto in a predetermined position by silicone adhesive or so forth.

When the power supply members 42 are electrified in the light emitting diode lamp 10 manufactured as described above, the light emitting diodes 34 are electrified through the power supply members 42, respectively, and emit light rays. The light rays emitted from the light emitting diodes 34 are refracted by the lenses 36, and propagate through optical paths as if they were emitted about the virtual images I. The light rays are reflected by the reflective surface 20, and then, are released to the outside from the light emitting diode lamp 10 through the front side cover 26 disposed on the opening 22.

According to the light emitting diode lamp 10 of the present practical example, the plural (nine) light emitting diode elements 40, composing one light emitting diode 34, emit light rays with the same wavelength, while the entire light emitting diodes 34, composing the plural light emitting diodes 34, emit light rays with at least two types of wavelength. Accordingly, one light emitting diode 34 illuminates a physical object while light rays emitted from the light emitting diode elements 40 composing one light emitting diode 34 are "displaced" at a predetermined amount. However, as described above, the light emitting diode elements 40 composing one light emitting diode 34 emit light rays with the same wavelength. Therefore, even with the light rays "displaced" as described above, the physical object does not appear to have uneven shades of color.

Additionally, the light emitting diodes 34 emit light rays with at least two types of wavelength. In other words, a given light emitting diode 34 emits light rays with different wavelength from those emitted from the other light emitting diodes 34. As described above, one light emitting diode 34 is herein configured to emit light rays with the same wavelength. Therefore, when a given light emitting diode 34 illuminates a physical object with light rays "displaced" by a predetermined amount, the other light emitting diodes 34 are configured to illuminate the physical object with light rays that are similarly "displaced" and have different wavelength from those emitted from the given light emitting diode 34. Thus, the physical object is illuminated with light rays that are similarly "displaced" and have different wavelengths from each other. Consequently, the physical object can be inhibited from appearing to have uneven shades of color.

(About Relation Between Dimension of Opening 22 in Reflective Surface 20 and Dimension of Pillar 32)

As described above, the pillar 32 also becomes the heat radiating material for the light emitting diodes 34. Therefore, the heat radiating performance of the pillar 32 is enhanced with increase in cross-sectional area of the pillar 32 (more specifically, a cross-sectional area of the pillar 32 cut along a plane orthogonal to the center axis C), and this enables the light emitting diodes 34 to be used in a high-power design capable of emitting as large an amount of light as possible.

However, it was found that another drawback emerges with increase in cross-sectional area of the pillar 32. Specifically, as described above, the virtual image I of each light emitting diode 34 is formed on the back of each light emitting diode 34 by each lens 36. The dimension of the virtual image I tends to increase with increase in distance of the position of the virtual image I from the actual position of each light emitting diode 34. In the light emitting diode lamp 10 according to the aforementioned practical example, it is one of the essentials to match the position of the virtual image I with the position of the focal point F of the reflective surface 20. Speaking further, it is required to match the positions of the virtual images I of the plural light emitting diodes 34 attached to the surface of the pillar 32 with the position of the focal point F uniquely defined by the reflective surface 20. Therefore, the position of the pillar 32 and that of the reflective mirror 12 are necessarily set such that the focal point F is located in the center of the cross-section of the pillar 32.

Because of this, the distance from the surface of the pillar 32 to the focal point F gradually increases with increase in cross-sectional area of the pillar 32. With increase in distance from the surface position of the pillar 32 (i.e., the actual position of each light emitting diode 34) to the focal point F, the virtual image I of each light emitting diode 34 tends to be enlarged accordingly. With increase in dimension of the virtual image I of each light emitting diode 34, among light rays emitted in appearance from the virtual image I, those emitted from the positions displaced from the focal point F gradually increase in number, and simultaneously, distance to the focal point F from each of the displaced positions also gradually increases. In other words, it is conceivable that the amount of light rays emitted off a desired illuminating region increases with increase in cross-sectional area of the pillar 32.

Figure 6:
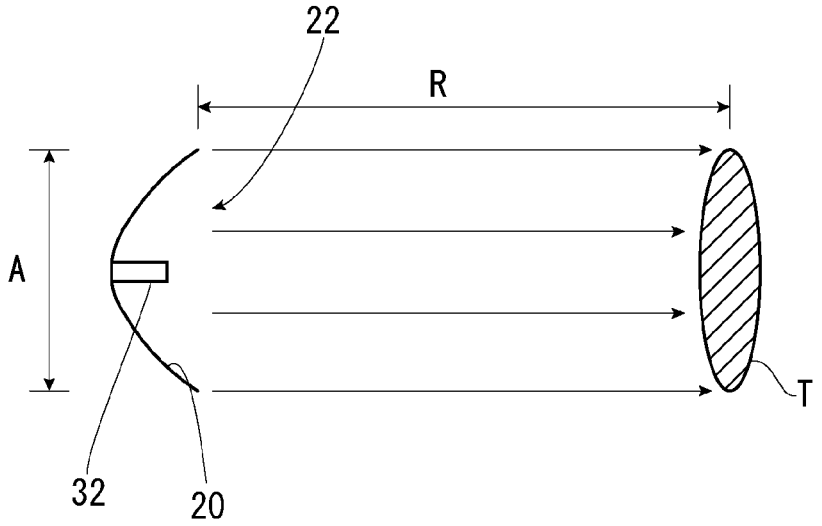
FIG. 6 is a diagram showing a model used in simulations.

In view of this, the relation between a diameter A (mm) of the opening 22 in the reflective surface 20 and a pillar radius B (mm) of the pillar 32 were examined with a model as shown in FIG. 6.

Figure 7:
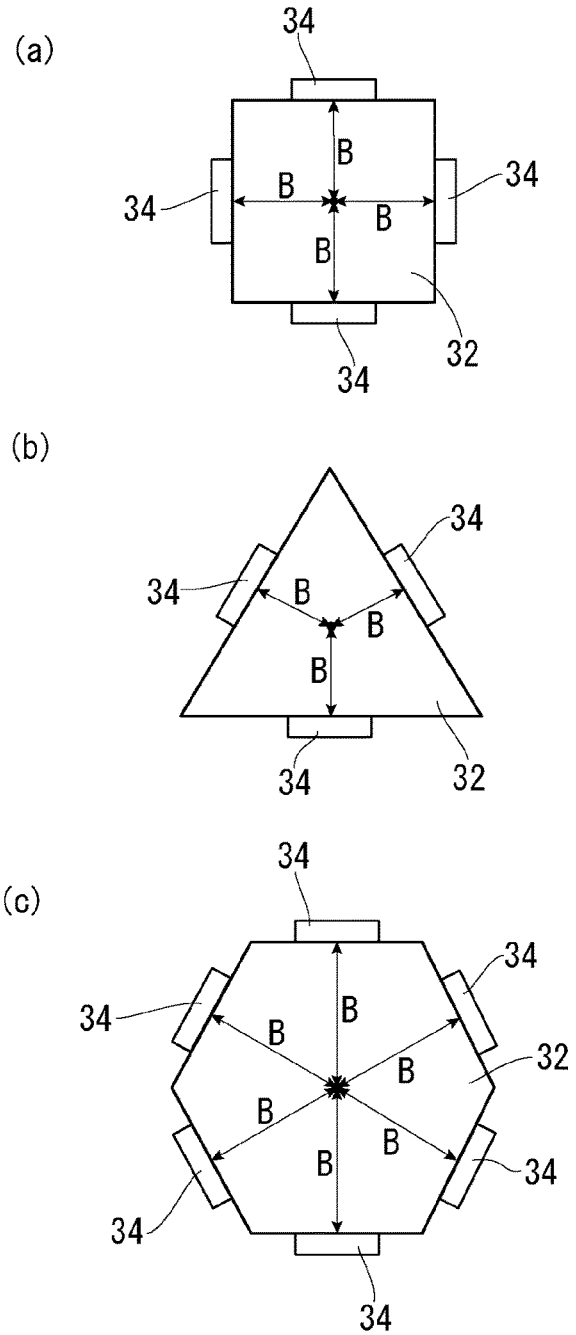
FIG. 7 is a diagram showing definition of a pillar radius B.

First, definition of "the pillar radius B" will be explained. As shown in FIG. 7, the pillar radius B is defined as a distance to the center of the pillar 32 from the surface of the pillar 32 making contact with the bottom surface of each light emitting diode 34. For example, when four light emitting diodes 34 are mounted to the pillar 32, the pillar 32 has a cross-section made in the shape of a square. In this case, the pillar radius B is obtained as a distance shown in FIG. 7(*a*). Likewise, when three light emitting diodes 34 are mounted to the pillar 32, the pillar 32 has a cross-section made in the shape of an equilateral triangle. In this case, the pillar radius B is obtained as a distance shown in FIG. 7(*b*). Moreover, when six light emitting diodes 34 are mounted to the pillar 32, the pillar 32 has a cross-section made in the shape of a regular hexagon. In this case, the pillar radius B is obtained as a distance shown in FIG. 7(*c*).

Referring back to FIG. 6, the model herein used will be explained. An object surface, located ahead of the opening 22 at a predetermined distance R, is emitted with light rays using the reflective mirror 12 including the reflective surface 20 defined by a paraboloid of revolution. In the model herein used, the distance R is set to be 10 meters. The distance R is not limited to this, and may be set to be several meters or several hundred meters. Theoretically, light rays emitted from the focal point F of the reflective surface 20 are reflected by the reflective surface 20, and are thereby emitted in the form of collimated light. Therefore, a region having the same dimension as the opening 22 on the target surface (hereinafter referred to as "target region T") is configured to be illuminated. However, in fact, the virtual image I of each light emitting diode 34 has a predetermined area larger than the actual area of each light emitting diode 34. Therefore, the light rays, emitted from the positions displaced from the focal point F, are reflected by the reflective surface 20, and then miss the target region T. Consequently, the light rays become no longer effective light rays.

In simulations, four light emitting diodes 34 were used, each of which is made in the shape of an approximate square with sides of 26 mm, and the pillar radius B of the pillar 32 was set to be 13 mm that is the minimum dimension enabling the four light emitting diodes 34 to be mounted to the pillar 32. Additionally, the diameter A of the opening 22 in the reflective surface 20 was set to be 260 mm that is twenty times as much as the pillar radius B (13 mm) of the pillar 32. The pillar radius B of the pillar 32 was set to be 13 mm as a reference, and the amount of light in the target region T was set to be 100% in use of the pillar 32 with this reference setting. The pillar radius B of the pillar 32 was variously increased from the reference setting without changing the diameter A of the opening 22 and the dimension of each light emitting diode 3. Then, the ratio of the amount of light in the target region T was obtained in the various settings of the pillar radius B. It should be noted that in general, the diameter A of the opening 22 in the reflective surface 20 falls in a range of 100 mm to 1000 mm.

Figure 8:
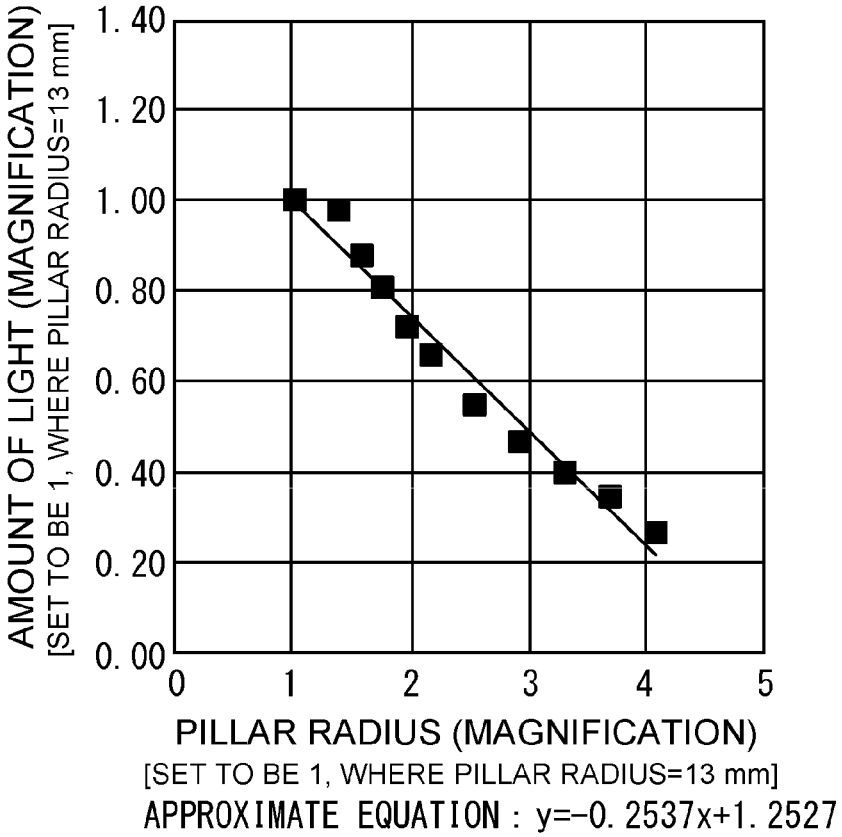
FIG. 8 is a chart showing simulation results.

Table 1 and FIG. 8 show simulation results. It should be noted that FIG. 8 is a chart showing a relation between magnification of the pillar radius B and the amount of light illuminating the target region T.

TABLE 1

| PILLAR RADIUS [mm] | PILLAR RADIUS (MAGNIFICATION) | AMOUNT OF LIGHT [%] |
|---|---|---|
| 13 | 1.00 | 100 |
| 18 | 1.38 | 98 |
| 21 | 1.58 | 88 |
| 23 | 1.77 | 81 |
| 26 | 1.96 | 72 |
| 28 | 2.15 | 66 |
| 33 | 2.54 | 55 |
| 38 | 2.92 | 47 |
| 43 | 3.31 | 40 |
| 48 | 3.69 | 34 |
| 53 | 4.08 | 27 |

The amount of light in the target region T was set to be 100% in use of the pillar 32 with the pillar radius B of 13 mm as a reference. When the amount of light in the target region T becomes less than 50%, the light emitting diode lamp 10 becomes unusable as merchandise. Additionally, the pillar radius B, corresponding to when the amount of light in the target region T was 100%, was set to be 1.00 on a magnification basis as a reference. When the pillar radius B is increased to 2.97 from the reference, the amount of light in the target region T becomes 50%. Therefore, the pillar radius B is required to fall in a range of "$1.00<B\leq 2.97$". It should be noted that the lower limit ratio of the amount of light in the target region T is reduced with increase in the distance R set in the model as the distance from the opening 22 to the object surface.

Furthermore, the amount of light in the target region T preferably falls in a range of 70% or greater. In other words, the pillar radius B preferably falls in a range of "$1.00<B\leq 2.18$".

As described above, the diameter A of the opening 22 in the reflective surface 20 was set to be 260 mm that is twenty times as much as the pillar radius B (13 mm) of the pillar 32. Therefore, the relation between the pillar radius B and the diameter A of the opening 22 in the reflective surface 20 is required to satisfy a relation "$0.05\times A<B\leq 0.1485\times A$" in which the amount of light in the target region T falls in a range of 50% or greater. It should be noted that the pillar radius B was set to be greater than 1/20 (=0.05) times as much as the diameter A of the opening 22 due to the following reason. When the pillar radius B is set to be smaller than this dimension, it becomes difficult to use the light emitting diodes 34 with a suitable power design for the dimension of the reflective surface 20 because of heat radiation of the light emitting diodes 34. It should be also noted that the dimension of the reflective surface 20 is determined based on that of the target region T.

Furthermore, the relation between the pillar radius B and the diameter A of the opening 22 in the reflective surface 20 preferably satisfies a relation "$0.05\times A<B\leq 0.109\times A$" in which the amount of light in the target region T falls in a range of 70% or greater.

As shown in the simulation results, the amount of light in the target region T reduces with increase in the pillar radius B. This is because of the following reason. The virtual image I of each light emitting diode 34 has a predetermined area larger than the actual area of each light emitting diode 45, and tends to be enlarged with increase in distance from the actual position of each light emitting diode 34 to the focal point F. Among light rays emitted in appearance from the virtual image I, those emitted from the positions displaced from the focal point F increase in number with increase in the pillar radius B. This results in increase in amount of light rays that are emitted off the target region T after reflected by the reflective surface 20.

Additionally, another reason for the above is that increase in the pillar radius B increases a probability that light rays emitted from the light emitting diodes 34 are reflected by the reflective surface 20 and then blocked by the pillar 32.

When a given light emitting diode 34 does not use a fluorescent body, the wavelength of light rays to be emitted therefrom increases with increase in temperature thereof during emitting of light rays. Therefore, the pillar radius B is preferably set such that the aforementioned relation between the pillar radius B and the diameter A of the opening 22 is satisfied, and simultaneously, the light emitting diodes 34 during emitting of light rays reach temperatures suitable for emitting of light rays with desired wavelengths.

Although the invention has been described in its preferred form with a certain degree of particularity, it is understood that the present disclosure of the preferred form has been changed in the details of construction and the combination and arrangement of parts may be resorted to without departing from the spirit and scope of the invention as hereinafter claimed.

The disclosure of Japanese Patent Application No. 2017-30723 filed on Feb. 22, 2017 including specification, drawings and claims is incorporated herein by reference in its entirely.

What is claimed is:

1. A light emitting diode lamp comprising:

a reflective mirror including a reflective surface on an inner side thereof, the reflective surface being defined by a surface of revolution, the reflective surface including an opening and a focal point;

a pillar extending from a bottom part of the reflective surface toward the opening; and a plurality of light emitters disposed in radial arrangement around the focal point on a surface of the pillar, wherein each of the plurality of light emitters includes a light emitting diode including a plurality of light emitting diode elements, the plurality of light emitting diode elements emitting light rays toward the reflective surface, and a lens disposed between the light emitting diode and the reflective surface, the lens refracting the light rays emitted from the light emitting diode toward the reflective surface, the lens forming a virtual image of the light emitting diode in a position of the focal point located behind the light emitting diode, and the plurality of light emitting diode elements of the light emitting diode in the each of the plurality of light emitters emit the light rays with the same wavelength, and the light emitting diodes of the plurality of light emitters emit the light rays with at least two types of wavelength.

2. The light emitting diode lamp according to claim 1, wherein the light emitting diodes of the plurality of light emitters emit the light rays in at least two amount settings.

3. The light emitting diode lamp according to claim 1, wherein the reflective surface is defined by a paraboloid of revolution, and the following relational expression is established between a diameter of the opening of the reflective surface and a pillar radius of the pillar:

$0.05 \times A < B \leq 0.1485 \times A$, where

A: the diameter (mm) of the opening of the reflective surface, and

B: the pillar radius (mm).

4. The light emitting diode lamp according to claim 1, wherein the reflective surface is defined by a paraboloid of revolution, and the following relational expression is established between a diameter of the opening of the reflective surface and a pillar radius of the pillar:

$0.05 \times A < B \leq 0.109 \times A$, where

A: the diameter (mm) of the opening of the reflective surface, and

B: the pillar radius (mm).

5. The light emitting diode lamp according to claim 3, wherein the pillar radius of the pillar is set such that the light emitting diode reaches a temperature at which the light emitting diode emits light rays with a predetermined wavelength.

6. The light emitting diode lamp according to claim 4, wherein the pillar radius of the pillar is set such that the light emitting diode reaches a temperature at which the light emitting diode emits light rays with a predetermined wavelength.

* * * * *